US005121309A

United States Patent [19]

Ewing et al.

[11] Patent Number: 5,121,309

[45] Date of Patent: Jun. 9, 1992

[54] INDUSTRIAL LUMINAIRE WITH A QUICKLY INSTALLED NEW AND IMPROVED OPTICAL ASSEMBLY

[75] Inventors: Robert L. Ewing, Granville; Robert J. Hayes, Gahanna; David G. Meredith, Westerville; Herbert A. Fouke, Newark, all of Ohio

[73] Assignee: Holophane Company, Inc., Newark, Ohio

[21] Appl. No.: 637,396

[22] Filed: Jan. 4, 1991

[51] Int. Cl.[5] ..... H01R 33/00

[52] U.S. Cl. ..... 362/226; 362/294; 362/368; 362/375; 362/396

[58] Field of Search ..... 362/226, 294, 345, 346, 362/374, 375, 453, 454, 368, 396, 404

[56] References Cited

U.S. PATENT DOCUMENTS

| | | | |
|---|---|---|---|
| 4,099,223 | 7/1978 | de Vos et al. | 362/226 |
| 4,222,093 | 9/1980 | Garcia et al. | 362/226 X |
| 4,363,086 | 12/1982 | Fletcher | 362/396 X |
| 4,459,648 | 7/1984 | Ullman | 362/226 X |

*Primary Examiner*—Stephen F. Husar
*Attorney, Agent, or Firm*—Cornelius P. Quinn

[57] ABSTRACT

An industrial luminaire assembly having an electrical assembly and an optical assembly pivotally mounted and latched thereto for quick installation and removal. The optical assembly also providing for compression of its glass prismatic reflector to strengthen it, and including a bottom closure pivotally mounted to provide access to the interior of the optical assembly for relamping.

7 Claims, 5 Drawing Sheets

INDUSTRIAL LUMINAIRE WITH A QUICKLY INSTALLED NEW AND IMPROVED OPTICAL ASSEMBLY

FIELD OF THE INVENTION

This invention relates generally to industrial luminaires and more specifically to an industrial luminaire with a new and improved optical assembly that may be quickly installed to an electrical assembly such as a ballast assembly or pendant attachment.

BACKGROUND OF THE INVENTION

It is desirable, in order to reduce on site installation and maintenance time to be able to provide an industrial luminaire which may be quickly installed and maintained at the job site without having to use any special tools or open the luminaire to make wiring splices or connections. It is also desirable to provide an industrial luminaire in which the optical assembly can be easily removed and another optical assembly installed to provide different lighting patterns and distributions to accommodate different lighting needs or requirements. In addition it is desirable to provide an industrial luminaire which has an optical assembly which is easy to relamp, is totally sealed to exclude insects, dust and dirt, and is provided with adequate circulation of clean air through its heating and cooling cycles. Still another desirable feature of an optical assembly, is to provide means whereby the glass prismatic reflector is put under compression making it stronger and less likely to break when accidentally struck.

Previously, known luminaires would often be shipped to the contractor at a job site whereupon they would be opened by the electrician to expose the internal wires which would then have to be spliced to matching electrical wires in a previously installed outlet box, and if after installation a change in the lighting pattern and distribution was desired, it was necessary to change the entire luminaire. Similarly, special tools were often necessary not only to install the luminaire but even to replace the lamp. In addition adequate measures were often not provided to keep out insects, dust and dirt from within the optical assembly of the luminaire.

BRIEF SUMMARY OF THE INVENTION

This invention provides an industrial luminaire with an attachable and removable novel optical assembly which can be attached or removed from an electrical assembly such as a ballast assembly and/or pendant support for a remote ballast without the need for any special tools, thus not only providing for quick installation but convenience in the removal and replacement of the optical assembly with another optical assembly having a different lighting pattern and distribution when such a change in lighting pattern or distribution is desired and ease in mounting optical assemblies having different lighting patterns and light distribution to various different ballast assemblies. In addition, the present invention provides disconnector terminals for connecting the electrical components of the optical assembly with an electrical assembly such as a ballast assembly or pendant support for a remote ballast, as well as a totally sealed optical assembly for the exclusion of insects, dust and dirt; a die cast aluminum lamp socket housing designed for the maximum dissipation of lamp heat; and the use of a fiberglass filter positioned between the lamp socket and the lamp housing to provide for a clean exchange of air during the lamp heating and cooling cycles.

The invention also provides a luminaire, the optical assembly of which includes a number of additional unique features including: an internally attached aluminum reflector providing support for the prismatic reflector, heat shielding for the socket area, and a reflective surface for reflecting the upward light emanating from the lamp to enhance the lighting output of the assembly; rods which are attached to bosses in the socket casting at the top and a steel support ring at the bottom for providing additional support as well as compression for the optical assembly's glass prismatic reflector so that by maintaining compression in the glass from top to bottom the reflector is less likely to break; and a bottom hinged and latched closure door, which is easily opened for relamping the luminaire.

These and other features and aspects of the invention, as well as its various benefits, will be made more clear in the detailed description of the invention which follows.

DESCRIPTION OF THE INVENTION

Figure 1:
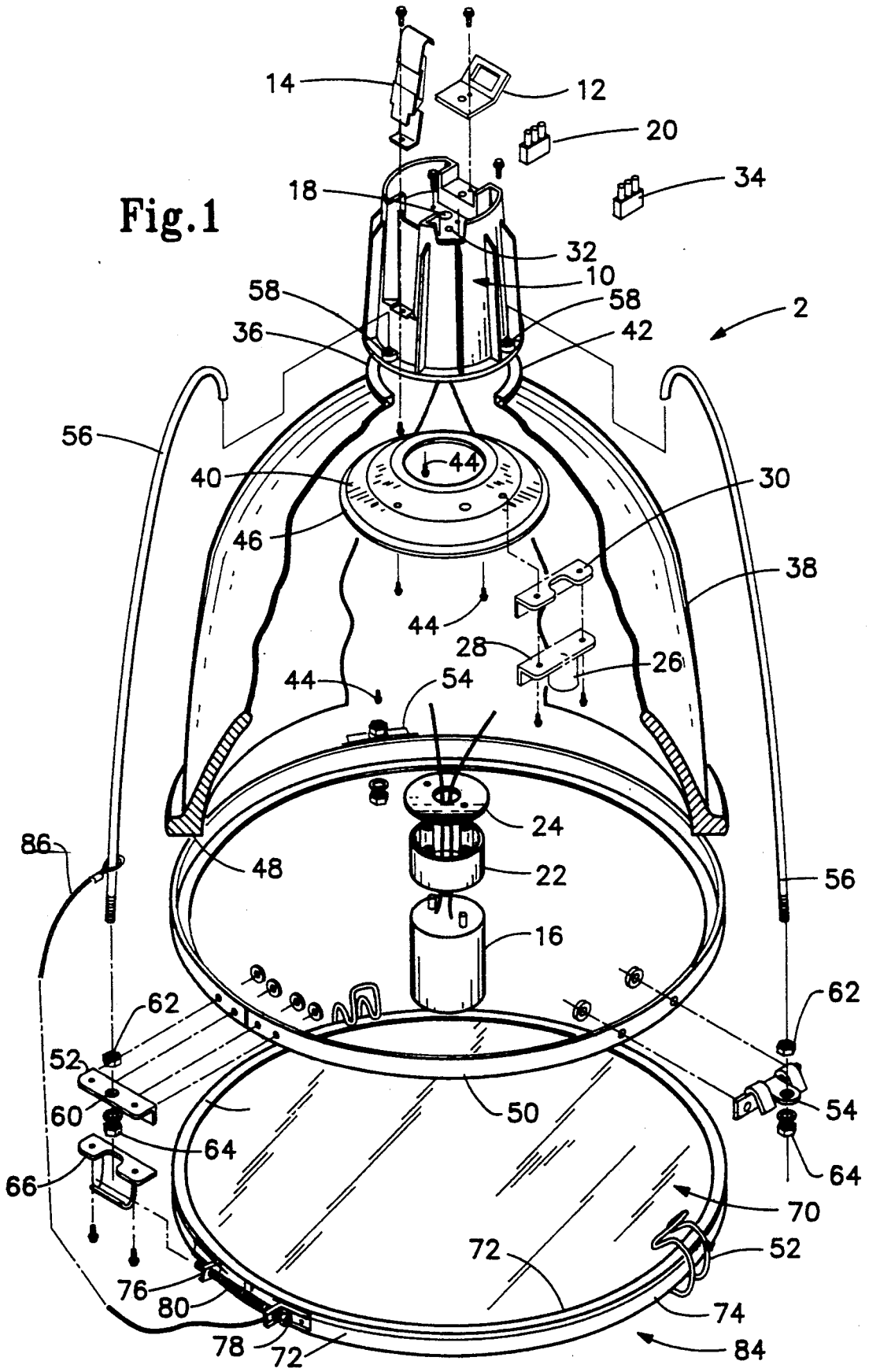
FIG. 1 is a perspective view of the optical assembly of the present invention, exploded to better illustrate all of its components.

Referring to FIG. 1 a perspective view of an optical assembly of the present invention, generally identified by the reference numeral 2, exploded to better illustrate all of its components, is shown as having a die cast aluminum socket housing 10, having a keeper 12, and a latch 14, attached thereto. The aluminum socket housing 10 is also provided with radiating fins 11, for maximum dissipation of lamp heat. An electrical socket 16, is provided for receiving a lamp (not shown). The electrical socket 16 is connected by wires through a hole 18, in the top of the socket housing 10 to a disconnect terminal 20. A socket spacer 22, used to adjust the different light center positions of the lamp of the optical assembly, and a fiber glass filter 24, separate the electrical socket 16 from direct contact with the socket housing 10. The fiber glass filter 24 filters the air passing through the socket housing 10 during the heating and cooling cycles of the lamp. Provision is also made for an auxiliary standby lamp 26. The auxiliary standby lamp 26 is mounted in an auxiliary electrical lamp socket 28, attached to a bracket 30. Wires fed through a hole 32 in the socket housing 10 connect the auxiliary electrical lamp socket 28 to a disconnect terminal 34. A gasket 36 positioned between the bottom of the socket housing 10 and an upper flange or lip 42 of the prismatic reflector 38 is cemented in place to the bottom of the socket housing 10. An internally mounted aluminum reflector 40 is provided not only to provide heat shielding for the socket area and provide a reflective surface for reflecting the upward light emanating from the lamp to enhance the lighting output of the assembly adding to the lighting output, but to provide support for the prismatic reflector 38. The internally mounted aluminum reflector 40 which overlaps the inner portion of the upper flange or lip 42 of the prismatic reflector 38 is fastened to the socket housing 10 by three screws 44 and thereby holds the prismatic reflector 38 in place as well. A gasket 46 positioned about the periphery of the internal aluminum reflector 40 is cemented in place and provides a buffer between the internal aluminum reflector 40 and the prismatic reflector 38. At the bottom of the prismatic reflector 38 there is an outwardly extending flange 48 around which a metal circular ring 50 is formed and sealed. The circular ring 50 has spaced about it and riveted to it a splice plate 52 and two brackets 54. Three rods 56, each of which has one end inserted in a boss 58 formed in the socket housing 10 and the other end threaded and extending through holes 60 in brackets 54 and/or splice plate 52 integrally connected to the circular ring 50, are securely fastened to the metal circular ring by nuts 62 serving as stops when nuts 64 are tightened. By tightening the nuts 64, the rods extending from the top to the bottom of the glass prismatic reflector 38 place the glass of the prismatic reflector 38 in compression strengthening the glass so that the reflector is much less likely to break if accidentally struck. A hinge 66 fastened to the splice plate 52 serves as a hinge for a bottom door assembly 68. The bottom door assembly, generally identified by the reference numeral 84, comprises a lens 70 around which a circular gasket 72 is positioned. A circular channel 74 with a pair of clips 76 and 78 riveted to it is placed over the circular gasket 72 and has its ends drawn together by the tightening of a screw 80 threaded through the clips 76 and 78. Two wire spring latches 82 are attached to the circular channel 74. When the bottom door assembly 84 is in its closed position the screw 80 is positioned in the hinge 66 and the spring latches 82 are engaged over the brackets 54. A relamping cable 86 is provided connected at one end to one of the rods 56 and at the other end to the screw 80.

Figure 2A:
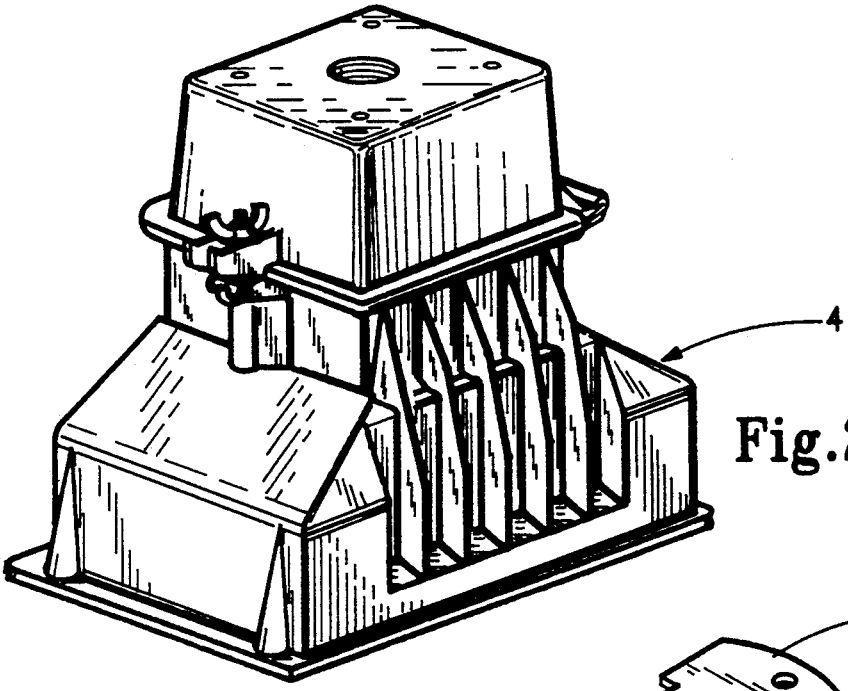
FIG. 2A is a perspective view of a 400 watt and smaller ballast assembly for utilization with an optical assembly of the present invention.
Figure 2B:
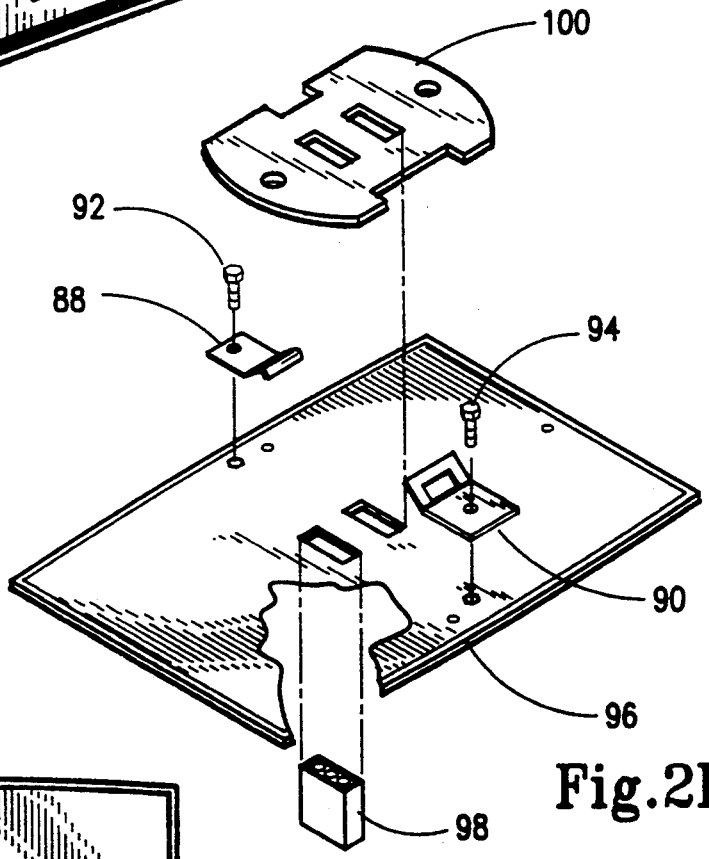
FIG. 2B is a bottom plan view of a 400 watt and smaller ballast assembly shown in FIG. 2A illustrating the hardware on the ballast assembly for connecting the optical assembly of the present invention thereto.
Figure 2C:
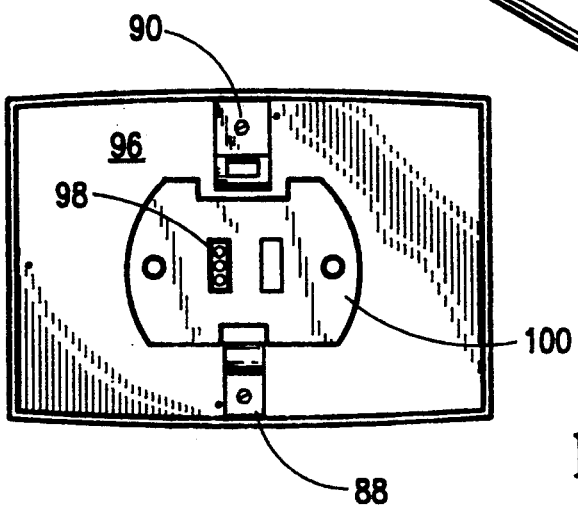
FIG. 2C is an exploded view of the hardware of FIG. 2B on the ballast assembly for connecting the optical assembly of the present invention thereto.

Referring to FIGS. 2A, 2B, and 2C there is shown a standard 400 watt and smaller wattage ballast assembly 4 modified in accordance with the present invention for quick engagement with the optical assembly 2 illustrated in FIG. 1. As illustrated in FIG. 2B a hinge 88 and a keeper 90 are attached to a plate 96 connected to the the bottom of the ballast assembly 4 by a pair of screws 92 and 94 respectively. A disconnect terminal 98 is positioned in a slot in the plate 96 for engagement with the disconnect terminal 20 of the optical assembly. In order to prevent vibration and insure a snug fit between the ballast assembly 4 and the optical assembly 2 when they are in engagement, a gasket 100 is secured to the top of plate 96.

Figure 3:
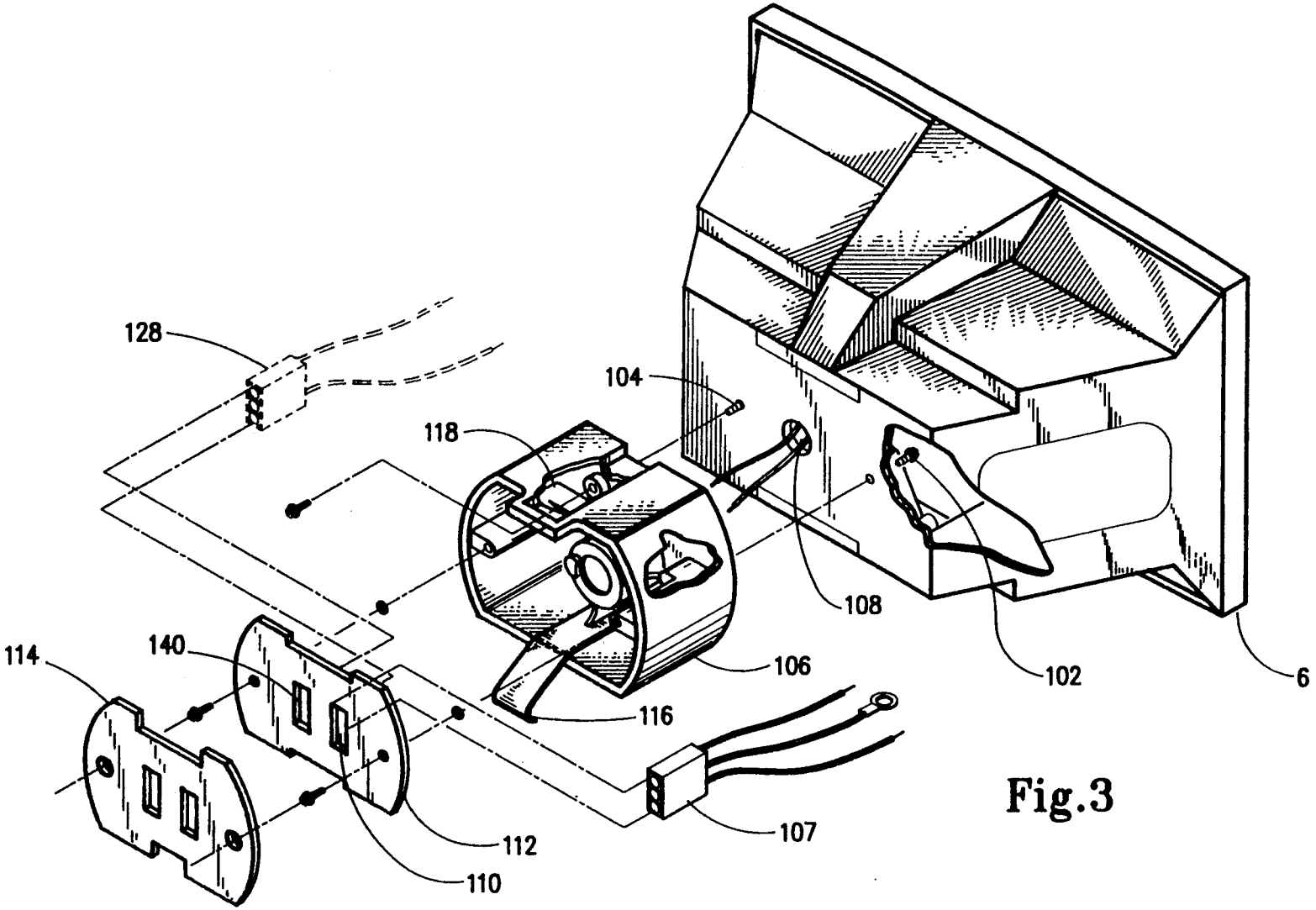
FIG. 3 is a perspective view of a 1000 watt ballast assembly for utilization with an optical assembly of the present invention, exploded to better illustrate all of its components.

Referring to FIG. 3 there is shown a 1000 watt ballast assembly 6 modified in accordance with the present invention for quick engagement with the optical assembly 2 illustrated in FIG. 1. Two screws 102 and 104 are used to connect a pendant casting 106 to the the bottom of the 1000 watt ballast assembly 6. A disconnect terminal 107 is connected to the ballast wires extending through a hole 108 in the bottom of the ballast assembly 6 and then inserted in a slot 110 in a cover plate 112 attached to the pendant casting 106 where it is held captive for engagement with the disconnect terminal 20 of the optical assembly. In order to prevent vibration and insure a snug fit between the ballast assembly 6 and the optical assembly 2 when they are in engagement, a gasket 114 is secured to the top of cover plate 112. A hinge 116 for receiving the keeper 12 of the optical assembly 2 and a slot 118 for engagement by the latch 14 of the optical assembly 2 are formed in the pendant casting 106.

Figure 4:
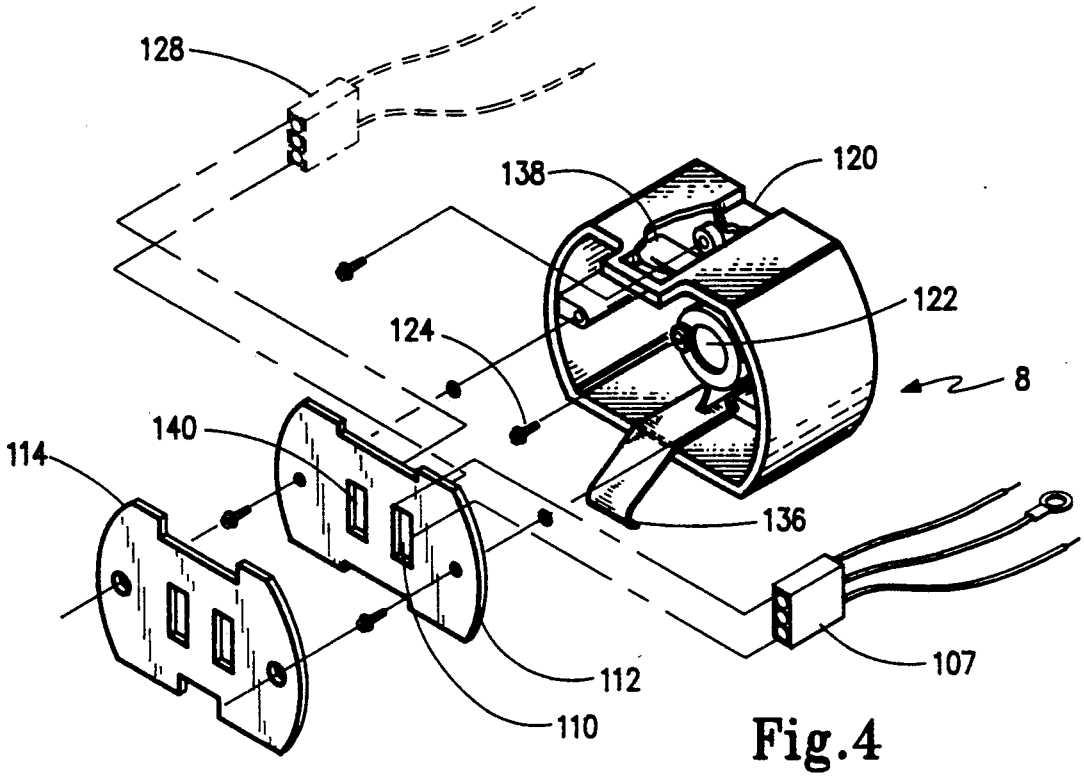
FIG. 4 is a perspective view of a pendant mounting assembly when a remote ballast is required, for utilization with an optical assembly of the present invention, exploded to better illustrate all of its components.

Referring to FIG. 4, there is shown a pendant mounting assembly 8 for quick engagement with the optical assembly 2 illustrated in FIG. 1. A pendant casting 120 of the same configuration as the pendant casting illustrated in FIG. 3 and having a threaded hole 122 is threaded onto a conduit and locked in place by a set screw 124. Just as illustrated above in FIG. 3, the disconnect terminal 107 is connected to the ballast wires, (in this instance the ballast wires are for connection to a remote ballast), and then inserted in the slot 110 in the cover plate 112 attached to the pendant casting 120 where it is held captive for engagement with the disconnect terminal 20 of the optical assembly. In order to prevent vibration and insure a snug fit between the pendant mounting assembly 8 and the optical assembly 2 when they are in engagement, the gasket 114 is secured to the top of the cover plate 112. A hinge 136 for receiving the keeper 12 of the optical assembly 2 and a slot 138 for engagement by the latch 14 of the optical assembly 2 are formed in the pendant casting 120.

As illustrated in FIGS. 3 and 4, a knock out hole 140 is provided in the cover plate 112 for the insertion of a disconnect terminal 128 (shown in phantom) for engagement with the disconnect terminal 34 in the optical assembly 2 to provide power to the auxiliary lamp socket 28 of the optical assembly 2.

Figure 5:
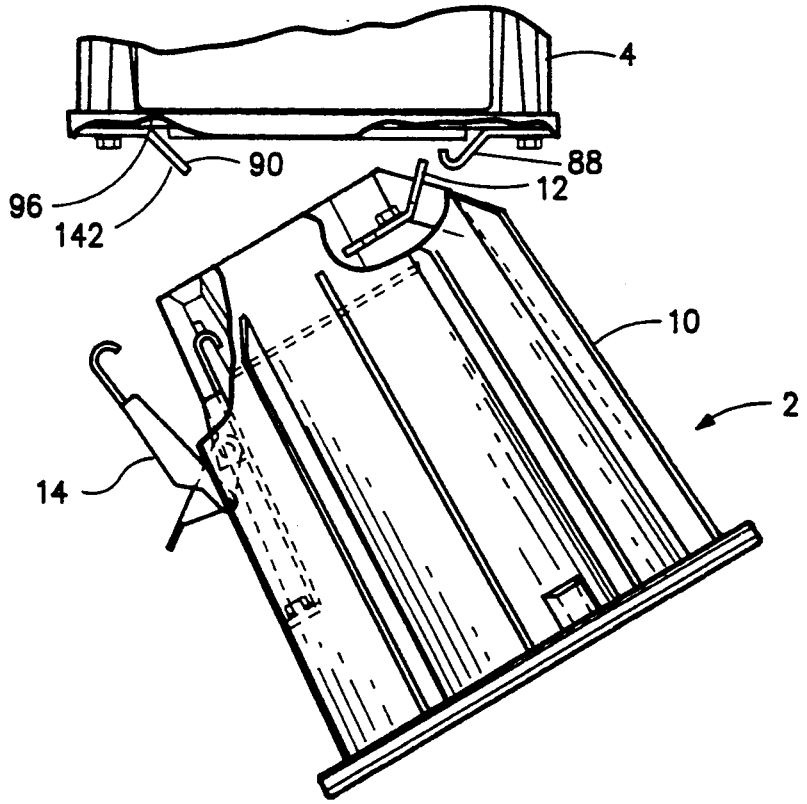
FIG. 5 is a side view illustrating the means for attaching the optical assembly of the present invention to a ballast assembly.

FIG. 5 illustrates the operation of the engagement of the optical assembly 2 to a 400 watt and smaller ballast assembly 4. The socket housing 10 of the optical assembly 2 is shown with the keeper 12 engaging the hinge 88 of the 400 watt and smaller ballast assembly 4 and the latch 14 mounted on the socket housing 10 adapted to engage a slot 142 in the keeper 90 attached to a plate 96 connected to the bottom of the ballast assembly 4 when the optical assembly is rotated in the clockwise direction.

Figure 6A:
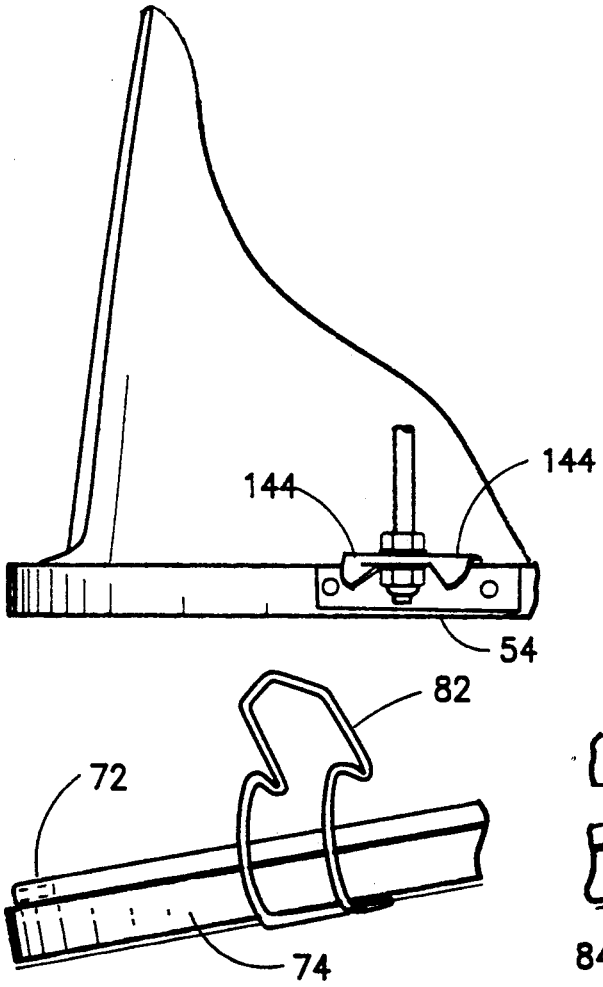
FIGS. 6A & 6B are side views illustrating the hinge and latching means of the bottom door assembly used for relamping the optical assembly of the present invention.
Figure 6B:
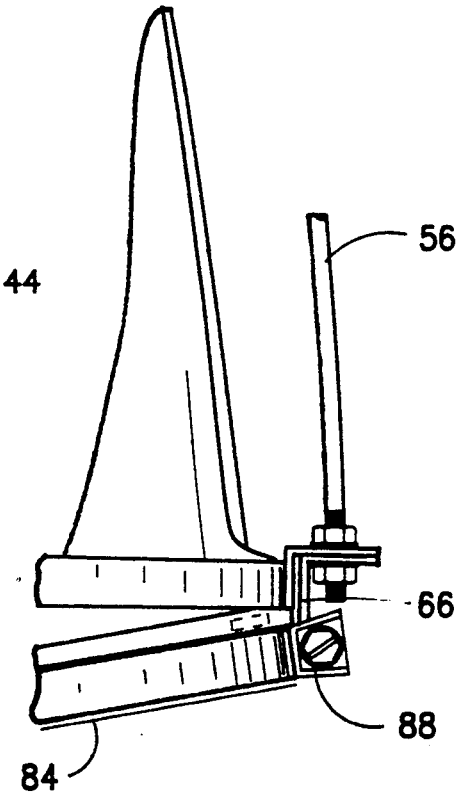

FIGS. 6A & 6B illustrate the hinge and latching means of the bottom door assembly used to open and close the bottom door assembly for relamping the optical assembly of the present invention. As shown in FIG. 6B the bottom door assembly 84 is pivoted about the screw 88 seated in the hinge 66. To open the bottom door assembly 84 the two wire spring latches 82 are disengaged from the latch brackets 54 and the bottom door assembly 84 is pivoted downward about the hinge 66. To close the bottom door assembly 84 the wire spring latches 82 are rotated over slides 144 formed on the latch brackets 54.

From the foregoing, it can be seen that there has been provided by the subject invention a new and novel luminaire assembly providing an easily installed and removable optical assembly requiring minimal maintenance time, and it should be obvious that although a preferred embodiment of the invention has been described, it is possible to make changes to certain specific details of the luminaire assembly without departing from the spirit and scope of the invention.

What is claimed is:

1. A new and improved industrial luminaire system comprising:

an optical assembly, having a socket housing, a lamp socket, a lamp, a reflector mounted therein, an electric assembly for physically supporting the optical assembly and providing an electrical power source to the lamp socket and the lamp of of said optical assembly, mechanical means for both fastening th e optical assembly to and disengaging it from the electrical assembly, electrical disconnect means for supplying electrical power from the electrical power source to the lamp socket of the optical assembly, said mechanical means including a latching mechanism both for quickly fastening the optical system to the electrical assembly and quickly disengaging it from the electrical power source, and said lamp socket housing being made of die cast aluminum and being provided with radiating fins for maximum dissipation of lamp heat.

2. A new and improved industrial luminaire as defined in claim 1 wherein the optical assembly is totally sealed to exclude insects, dust, and dirt, and has a fiber glass filter positioned between the socket housing and the lamp socket to insure a clean exchange of air during lamp heating and cooling cycles.

3. A new and improved industrial luminaire as defined in claim 2 wherein the optical assembly includes a prismatic reflector and an internally attached aluminum reflector providing support for the prismatic reflector, heat shielding for the socket and a reflective surface for reflecting any upward light to enhance the lighting output of the optical assembly.

4. A new and improved industrial luminaire as defined in claim 3 wherein longitudinal rods each of which has one end connected to the socket housing at the top and the other end threaded and extending through holes in a metal support ring at the bottom engaging a lower flange of the prismatic reflector are securely fastened to the metal support ring by nuts engaging their threaded ends the tightening of which not only provides additional support for the prismatic reflector but places the glass of the prismatic reflector in compression strengthening the glass so that the reflector is much less likely to break if accidentally struck.

5. A new and improved industrial luminaire as defined in claim 4 wherein the optical assembly includes a bottom closure for providing access to the interior of the optical assembly for relamping.

6. A new and improved industrial luminaire as defined in claim 5 wherein the bottom closure is pivotally mounted on a hinge and normally held in a closed position by a pair of spring latches.

7. A new and improved industrial luminaire system as defined in claim 1, wherein interchangeable optical assemblies provide various light distribution patterns without a need to change said electrical assembly.

* * * * *